US008063347B1

(12) United States Patent
Urbano et al.

(10) Patent No.: US 8,063,347 B1
(45) Date of Patent: Nov. 22, 2011

(54) SENSOR INDEPENDENT ENGAGEMENT DECISION PROCESSING

(75) Inventors: Leonardo F. Urbano, Ridgewood, NY (US); Gregory F. Bock, Ivyland, PA (US); Ivy T. Moffett, Cherry Hill, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 456 days.

(21) Appl. No.: 12/355,851

(22) Filed: Jan. 19, 2009

(51) Int. Cl.

| | |
|---|---|
| ***F42B 15/01*** | (2006.01) |
| ***F41G 7/00*** | (2006.01) |
| ***F41G 9/00*** | (2006.01) |
| *F42B 15/00* | (2006.01) |
| *G01S 13/00* | (2006.01) |

(52) U.S. Cl. ..... 244/3.1; 89/1.11; 244/3.15; 244/3.16; 244/3.19; 342/61; 342/62; 342/175; 342/195

(58) Field of Classification Search ..... 244/3.1–3.19, 244/3.2–3.3; 89/1.11; 342/52–55, 61, 62, 342/175, 195, 59, 73–81, 89, 94–97
See application file for complete search history.

(56) References Cited

U.S. PATENT DOCUMENTS

| | | | | | |
|---|---|---|---|---|---|
| 3,883,091 | A | * | 5/1975 | Schaefer | 244/3.13 |
| 4,347,996 | A | * | 9/1982 | Grosso | 244/3.16 |
| 4,522,356 | A | * | 6/1985 | Lair et al. | 244/3.15 |
| 4,817,495 | A | * | 4/1989 | Drobot | 89/1.11 |
| 4,843,459 | A | * | 6/1989 | Perrin et al. | 244/3.16 |
| 4,848,208 | A | * | 7/1989 | Kosman | 89/1.11 |
| 4,925,129 | A | * | 5/1990 | Salkeld et al. | 244/3.11 |
| 5,197,691 | A | * | 3/1993 | Amon et al. | 244/3.13 |
| 5,206,452 | A | * | 4/1993 | Stamper et al. | 89/1.11 |
| 5,294,930 | A | * | 3/1994 | Li | 244/3.12 |
| 5,340,056 | A | * | 8/1994 | Guelman et al. | 244/3.16 |
| 5,425,514 | A | * | 6/1995 | Grosso | 244/3.22 |
| 5,435,503 | A | * | 7/1995 | Johnson et al. | 244/3.15 |
| 5,458,041 | A | * | 10/1995 | Sun et al. | 89/1.11 |
| 5,464,174 | A | * | 11/1995 | Laures | 244/3.11 |
| RE35,553 | E | * | 7/1997 | Li | 244/3.12 |
| 5,855,339 | A | * | 1/1999 | Mead et al. | 244/3.11 |
| 5,862,496 | A | * | 1/1999 | Biven | 244/3.15 |
| 5,917,442 | A | * | 6/1999 | Manoogian | 342/62 |
| 5,992,288 | A | * | 11/1999 | Barnes | 89/1.11 |

(Continued)

OTHER PUBLICATIONS

Kauderer, "Air Directed Surface-to-Air Missile Study Methodology," Johns Hopkins APL Technical Digest, vol. 21, pp. 244-250 (Nov. 2, 2000).

(Continued)

*Primary Examiner* — Bernarr Gregory
(74) *Attorney, Agent, or Firm* — Howard IP Law Group, PC

(57) ABSTRACT

A method for engaging a target uses sensors to generate target track(s). The tracks are projected forward in time and associated with a track quality measure. The maximum seeker look angle and beamwidth, acceleration, and net radar sensitivity characteristics are listed for each type of interceptor. A plurality of target intercept times are generated for each interceptor type. The probability that the interceptor can acquire the target is determined from the projected target tracks, the quality measure, and the characteristics. The probability of hitting the target is determined from the probability of acquisition and acceleration of the interceptor type. The probabilities of acquisition and of hitting the target are aggregated, and the type of interceptor to use is the type having (a) an extreme value of the aggregation or (b) the earliest intercept time from among the interceptors having an aggregation value above a threshold value.

20 Claims, 8 Drawing Sheets

U.S. PATENT DOCUMENTS

| | | | | |
|---|---|---|---|---|
| 6,497,169 | B1 * | 12/2002 | Khosla | 89/1.11 |
| 6,527,222 | B1 * | 3/2003 | Redano | 244/3.14 |
| 6,549,158 | B1 * | 4/2003 | Hanson | 342/195 |
| 6,563,450 | B1 * | 5/2003 | Wallace | 342/62 |
| 6,564,146 | B1 * | 5/2003 | Meyer et al. | 244/3.19 |
| 6,568,628 | B1 * | 5/2003 | Curtin et al. | 244/3.14 |
| 6,575,400 | B1 * | 6/2003 | Hopkins et al. | 244/3.19 |
| 6,603,421 | B1 * | 8/2003 | Schiff et al. | 342/62 |
| 6,630,902 | B1 * | 10/2003 | Fenton et al. | 342/62 |
| 6,666,401 | B1 * | 12/2003 | Mardirossian | 244/3.11 |
| 6,739,547 | B2 * | 5/2004 | Redano | 244/3.14 |
| 6,839,662 | B2 * | 1/2005 | Schnatterly et al. | 89/1.11 |
| 6,842,138 | B1 * | 1/2005 | Wilkinson | 342/62 |
| 7,009,554 | B1 | 3/2006 | Mookerjee et al. | |
| 7,026,980 | B1 | 4/2006 | Mavroudakis et al. | |
| 7,032,858 | B2 * | 4/2006 | Williams | 244/3.15 |
| 7,046,187 | B2 * | 5/2006 | Fullerton et al. | 342/54 |
| 7,047,161 | B1 | 5/2006 | Friesel | |
| 7,137,588 | B2 * | 11/2006 | Humphrey | 244/3.15 |
| 7,159,500 | B2 * | 1/2007 | John et al. | 89/1.11 |
| 7,190,304 | B1 * | 3/2007 | Carlson | 342/62 |
| 7,219,853 | B2 * | 5/2007 | Williams | 244/3.14 |
| 7,236,121 | B2 * | 6/2007 | Caber | 342/62 |
| 7,248,206 | B1 | 7/2007 | Boka et al. | |
| 7,277,047 | B1 | 10/2007 | Mookerjee et al. | |
| 7,283,938 | B1 | 10/2007 | Friesel | |
| 7,295,149 | B1 | 11/2007 | Wolf | |
| 7,348,918 | B2 * | 3/2008 | Redano | 342/62 |
| 7,394,047 | B1 * | 7/2008 | Pedersen | 244/3.1 |
| 7,411,543 | B1 * | 8/2008 | Boka | 89/1.11 |
| 7,473,876 | B1 * | 1/2009 | Pedersen et al. | 244/3.1 |
| 7,487,933 | B1 * | 2/2009 | Chen et al. | 244/3.15 |
| 7,511,252 | B1 * | 3/2009 | Pedersen et al. | 244/3.1 |
| 7,513,455 | B1 * | 4/2009 | Mavroudakis et al. | 244/3.15 |
| 2003/0019350 | A1 * | 1/2003 | Khosla | 89/1.11 |

OTHER PUBLICATIONS

Benaskeur et al, "Target Engageability Improvement Through Adaptive Tracking," Journal of Advances in Information Fusion, vol. 2, No. 2, pp. 99-112 (Dec. 2007).

Rhëaume et al, "Target Engageability Improvement Through Adaptive Data Fusion and Sensor Management: An Approach Based on the Fire Control Radar Search to Lock-on Time," Defence R&D Canada—Valcartier, Technical Report DRDC Valcartier TR 2006-785 (May 2008).

* cited by examiner

SENSOR INDEPENDENT ENGAGEMENT DECISION PROCESSING

This invention was made with Government Support under Contract No. Aegis N00024-98-C-5197 awarded by the Department of the Navy. The Government has certain rights in this invention.

BACKGROUND OF THE INVENTION

Protection against hostile targets such as missiles has been a desideratum for many years. Many systems exist for intercepting such hostile targets.

The problem of defending an asset against multiple targets involves optimal scheduling of weapon system sensor and interceptor resources. A combat system scheduling function (or "engagement scheduler") usually prioritizes a set of candidate intercepts based on the interval of time during which each target is most susceptible to intercept. A combat system engageability function supports the engagement scheduler by estimating the interval of time most amenable to successful intercept for each target.

Determining the time interval over which a target is most susceptible to intercept by a given interceptor requires knowledge of the interceptor seeker and kinematic characteristics.

Improved interceptor missile fire control systems are desired.

SUMMARY OF THE INVENTION

Thus, a method for engaging a target according to an aspect of the invention comprises the steps of providing a plurality of sensors for producing track data representing target tracks. These target tracks are subject to uncertainty in the form of state and covariance, as known in the art. The target tracks are projected forward in time to thereby generate projected target tracks. The projected target tracks are evaluated, and an estimated quality measure is associated with each projected target track. A listing is generated, either on-the-fly or from stored information, listing at least the characteristics of (a) maximum seeker look angle with its uncertainty, (b) acceleration or other kinetic capability (Amax), (c) seeker beamwidth, and (d) the net radar sensitivity (including transmitter power), for all available interceptor missiles. The characteristics may preferably include the interceptor autopilot lag. A plurality of target intercept times are determined for each of the types of interceptor. The probability that the interceptor can acquire the target (possibly expressed as the probability mass function) is determined for each of the available interceptor missiles and for each of the plurality of intercept times, using the target tracks, the quality measures, and the characteristics. The probability of the interceptor missile hitting the target is determined for each of the interceptor missile types, using the track quality, the probability mass function of the acquisition of the target by the missile, and the acceleration or kinematic characteristics of the interceptor missile. The probabilities of acquisition and the probabilities of hitting the target are aggregated for each type of interceptor missile, and the type of interceptor missile to use is determined by selecting either (a) that type of interceptor missile having a maximum value of the aggregation which exceeds the threshold value or (b) that type of interceptor that has the earliest intercept time that exceeds the threshold value. A further step may include at least one of launching and controlling the selected one of the interceptor missiles.

In a particular mode of the method, the step of aggregating includes the steps of computing the probability mass function of the probability of target acquisition and the conditional probability of kinematic capability given target acquisition after each seeker scan, and summing the product of the probability mass density and the probability of kinematic capability over a finite number of seeker scans to compute the probability of guidance.

In one mode of the method, the step of evaluating the target tracks and associating an estimated quality measure with each projected target tracks is based upon estimated sensor errors as a function of range.

A method according to another aspect of the invention is for engaging a target. The method comprises the steps of providing a plurality of sensors for producing track data representing target tracks. The track data is projected forward in time to thereby generate projected target tracks including target state and covariance. The projected target tracks are evaluated, and an estimated quality measure is associated with each projected target track. For all available interceptor missiles, a listing is generated of at least the characteristics of (a) maximum seeker look angle, (b) maximum acceleration or other kinematic capability, (c) net radar sensitivity, (d) seeker beamwidth, and (e) possibly interceptor autopilot lag. A plurality of target intercept times are determined for each of the available types of interceptors. For each of the plurality of target intercept times, and using the projected target tracks, the quality measures, and the characteristics, a determination is made, for each of the available interceptors, of the target acquisition probability mass function. For each of the interceptor types, from the maximum available interceptor acceleration or other kinetic capability and from the amount of energy required to remove the heading error to the target, a determination is made of one of the conditional probability of kinematics and the probability mass function of the probability of kinematics. The instantaneous probability of guidance or probability of hitting the target is generated as an aggregation which is the multiplicative product of (a) the target acquisition probability mass function and (b) the one of the conditional probability of kinematics and the probability mass function of the probability of kinematics. The type of interceptor to be launched is selected as that type having an extreme value of the resulting aggregation. The extreme value may be a maximum. In a particular mode of this method, the selected one of the interceptors is launched. Another mode of the method further comprises, after the step of determining the instantaneous probability of guidance or probability of hitting the target, the step of selecting for further processing only those values of instantaneous probability of guidance or probability of hitting the target which exceed a given threshold, representing a lower limit of acceptable missile performance, to thereby define a set of acceptable interceptors. Yet another mode further comprises the step of determining, if not already determined, target intercept time for each interceptor of the set of acceptable interceptors, and selecting from among the interceptors of the set that one having the earliest intercept time.

DESCRIPTION OF THE INVENTION

Figure 1:
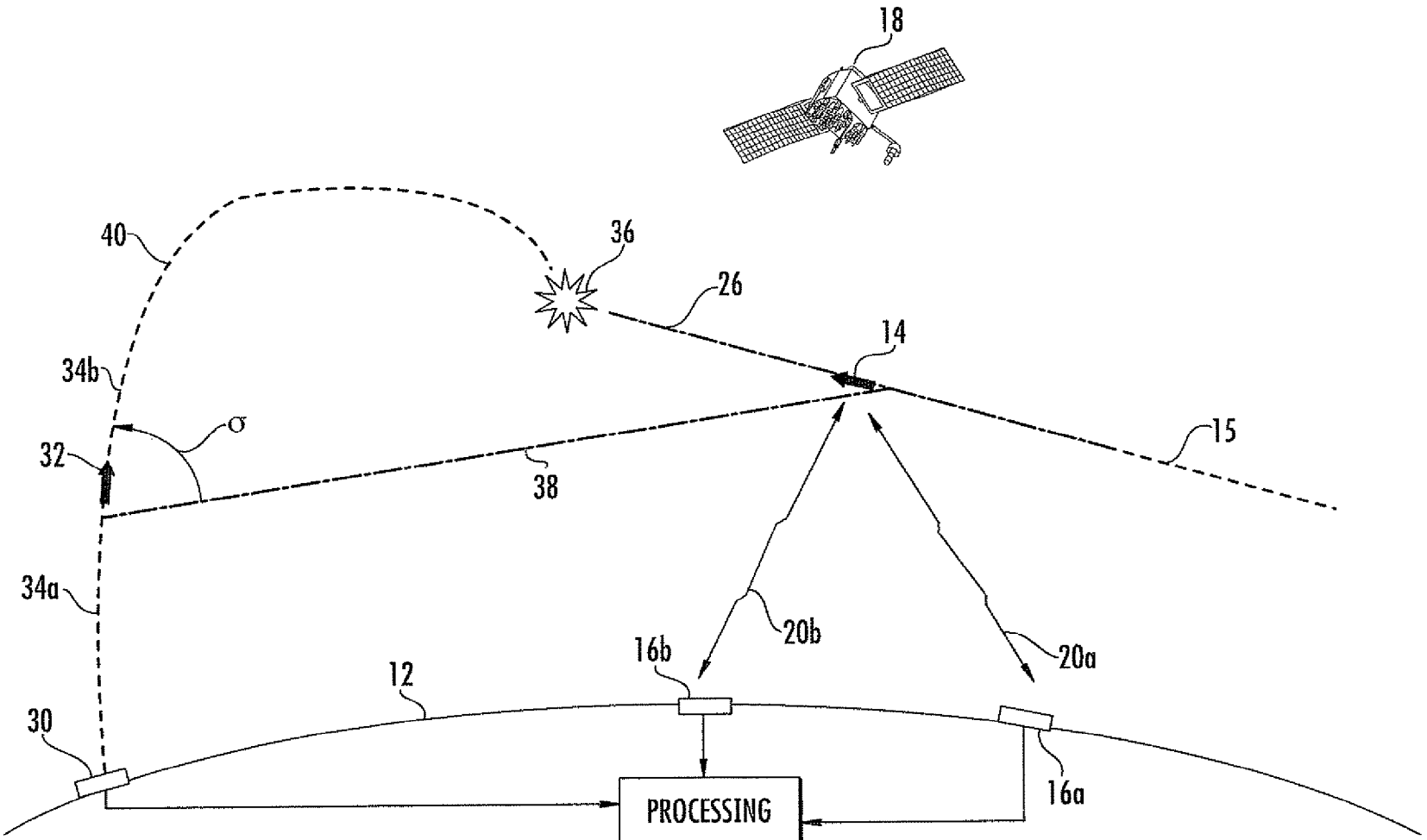
FIG. 1 is a simplified representation of a portion of an engagement region including a horizon, a target missile, a plurality of sensors which track or otherwise sense the target missile, a processing arrangement linked to a ship having antimissile or interceptor missile launch capabilities, an interceptor missile, and some geometry associated with countermeasures.

In FIG. 1, an engagement region 10 includes a horizon 12. A hostile missile 14 follows a track illustrated by dash line 15. A plurality of sensors are available for sensing the region 10. These sensors include an Overhead Non-Imaging InfraRed (ONIR) spacecraft 18 and first and second radar systems 16*a* and 16*b*, respectively. Radar system 16*a* senses the hostile missile 14 by means of electromagnetic energy flowing in a path represented by a "lightning bolt" symbol 20*a*, and radar system 16*b* senses the hostile missile 14 by means of electromagnetic energy flowing in a path represented as 20*b*.

The track information produced by sensors 16*a* and 16*b* of FIG. 1 includes instantaneous hostile missile state information, with associated covariance, all as known in the art. The information and covariance is made available to processing, which may be either distributed or at a specific site. In FIG. 1, the processing is illustrated as a block 24. The processing represented by block 24 may be associated with an antimissile or interceptor missile site, such as a ship illustrated as 30. Block 24 generates hostile missile track information from the state information and covariance, and projects the track into the future, to thereby produce an estimated track, illustrated as a dot-dash line 26.

Processing block 24 of FIG. 1 also has available other information, either preloaded into memory or made available on-line. This other information includes such things as an inventory of the types and number of antimissile or interceptor assets aboard ship 30 and other similar antimissile sources (not illustrated in FIG. 1), and information as to the characteristics of each of the different types of antimissile assets. This information, as described below, may include antimissile seeker sensitivity and look angle information, and antimissile kinematic capability, such as acceleration.

Ship 30 of FIG. 1 may also include one or more illuminators, which are used to illuminate targets during engagement of a hostile missile by means of an interceptor which uses semi-active seeking. In this context, an "active" seeker on an interceptor missile transmits electromagnetic radiation toward the target, and seeks or homes on the target using the electromagnetic energy reflected from the target. A "semi-active" seeker does not transmit electromagnetic energy, but relies for homing upon receipt of electromagnetic energy from an "illuminator" which is not co-located with the seeker. Each type of seeker has advantages and disadvantages. The electromagnetic power that can be generated on-board an antimissile may be less than that which can be generated by a shipborne illuminator, and the seeking range may therefore be less. On the other hand, an active seeker can be more autonomous, but may be more subject to countermeasures.

As illustrated in FIG. 1, the scenario 10 includes an antimissile 32 which is controlled to follow a path illustrated as a dash line 34*a* and which will be controlled to follow a further dash line 34*b* to a point 36 representing a collision between the hostile missile 14 and the antimissile 32. While following paths 34*a* and 34*b*, an angle σ is defined between the longitudinal axis of the antimissile 32 and the line-of-sight 38 extending between the antimissile 32 and the hostile target 14. More particularly, since the seeker axis is generally aligned with the longitudinal axis of the antimissile, the seeker axis will substantially coincide with the track 34*b* at point 40 of FIG. 1. Point 40 of FIG. 1 may be viewed as being the point (or time T0) at which the seeker of the interceptor missile is activated. Of course, if the seeker axis should not be substantially coincident with the antimissile 32 track 34*b*, the geometrical problem is defined differently, but this has no particular effect on an understanding of the invention.

Figure 2:
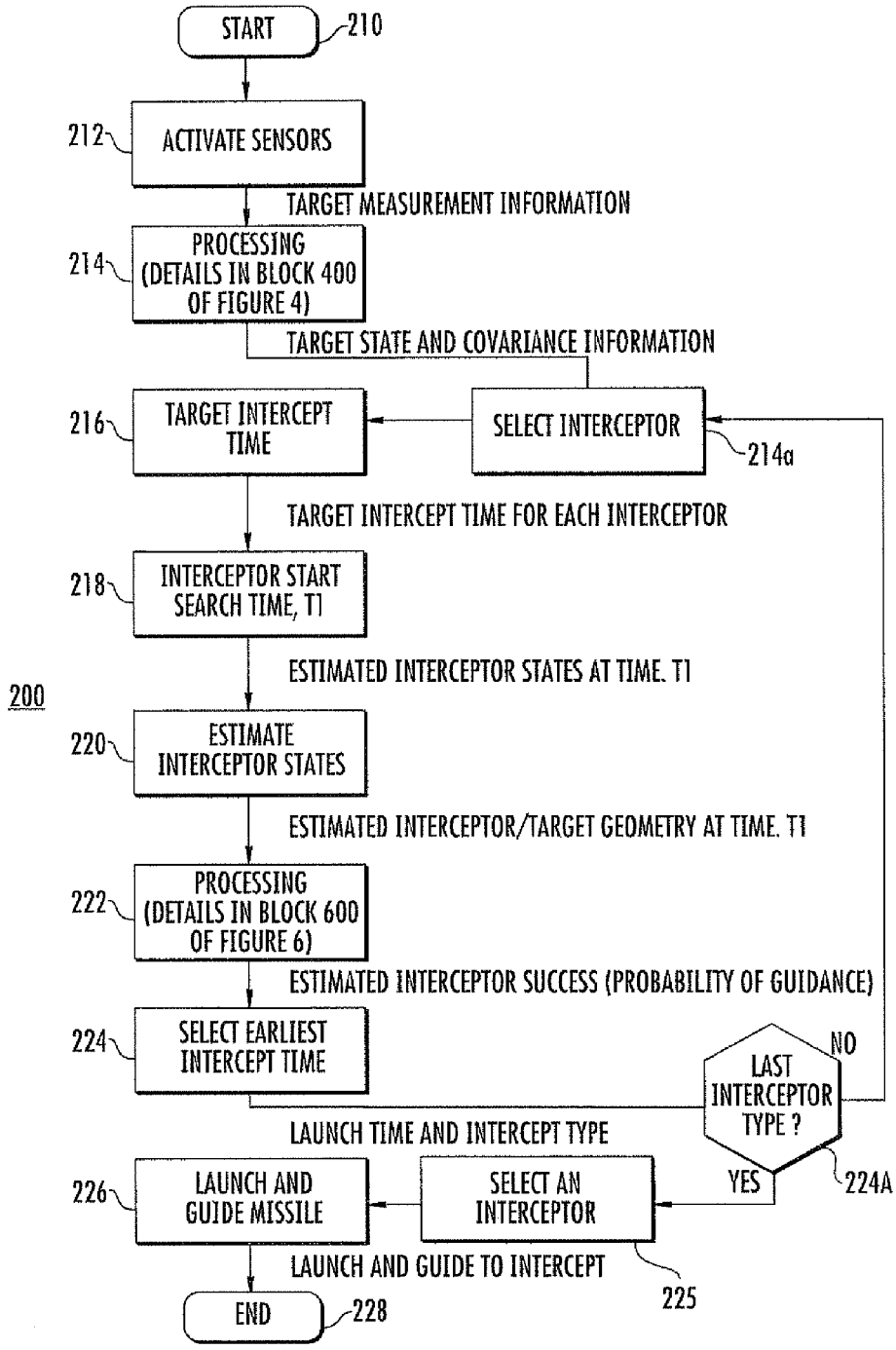
FIG. 2 is a simplified logic flow chart or diagram illustrating a method according to an aspect of the invention.

FIG. 2 is a simplified logic flow chart or diagram 200 illustrating a method according to an aspect of the invention for engaging a hostile target which is detected by sensors. The logic 200 may operate in processor 24 of FIG. 1. In FIG. 2, the logic begins at a START block 210, and flows to a block 212, representing the starting or bringing on-line of the sensors (noted as sensor 16*a*, 16*b*, 18, 30 in FIG. 1), or possibly representing the acquisition of target state and covariance measurement information from the sensors. From block 212, the logic 200 of FIG. 2 flows to a block 214, which represents use of the processor 24 of FIG. 1 to generate target tracks (the history of the state and covariance), and to project the target tracks into the future, as known in the art. Block 214 also represents evaluating the target tracks and associating an estimated quality measure with each projected target track, as described in more detail in conjunction with FIG. 4. This estimated quality measure is different from simple covariance, as it is dependent upon the characteristics of the sensor(s) and upon the distance between the sensor and the target missile, which changes as a function of time, possibly because the target missile is on a track which approaches or recedes from the sensor, or because the sensor itself is moving, or both.

Figure 3A:
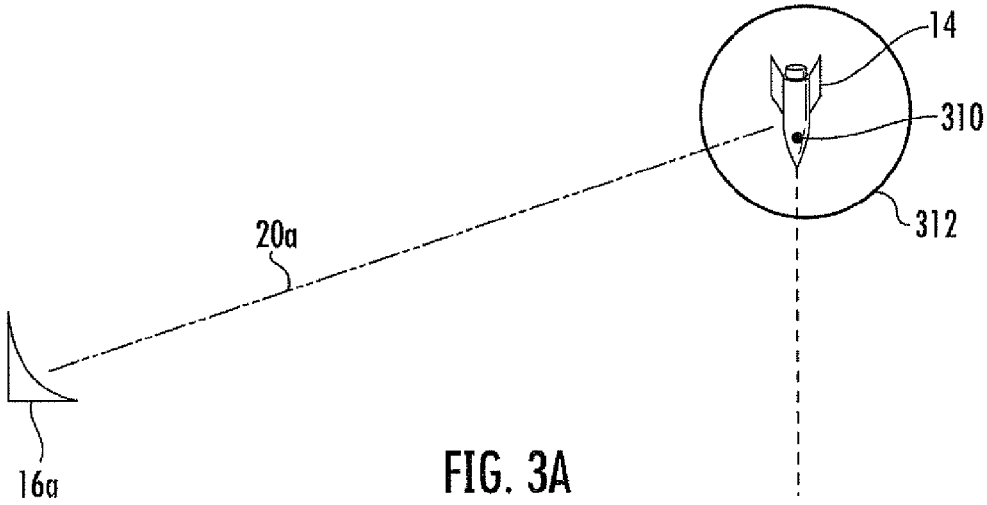
FIG. 3A is a simplified diagram showing geometry associated with a sensor viewing a target at a first range, showing the uncertainty in the target location.
Figure 3B:
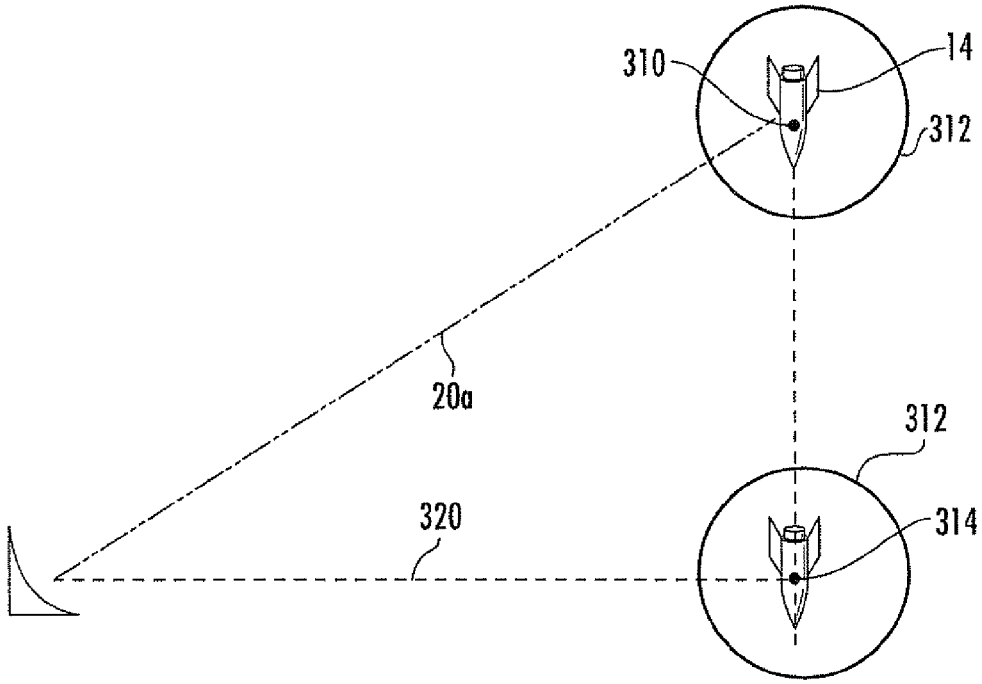
FIG. 3B is a diagram similar to that of FIG. 3A showing the uncertainty at a second range, less than the first range.

FIG. 3A is a simplified diagram conceptually illustrating the state or location 310 of a hostile target or missile 14 as reported by a sensor, illustrated as sensor 16*a*, together with a circle about the location 310 representing the error in the state as indicated by the covariance of the report. FIG. 3B illustrates the scenario of FIG. 3A at a later time, at which time the target missile 14 has moved from location 310 to a location 314. When target missile 14 is at location 314, it is sensed along a range line 320, which is shorter than line 20*a*. Consequently, the error in the state, represented by circle 322, is smaller than the error represented by circle 312.

Figure 4:
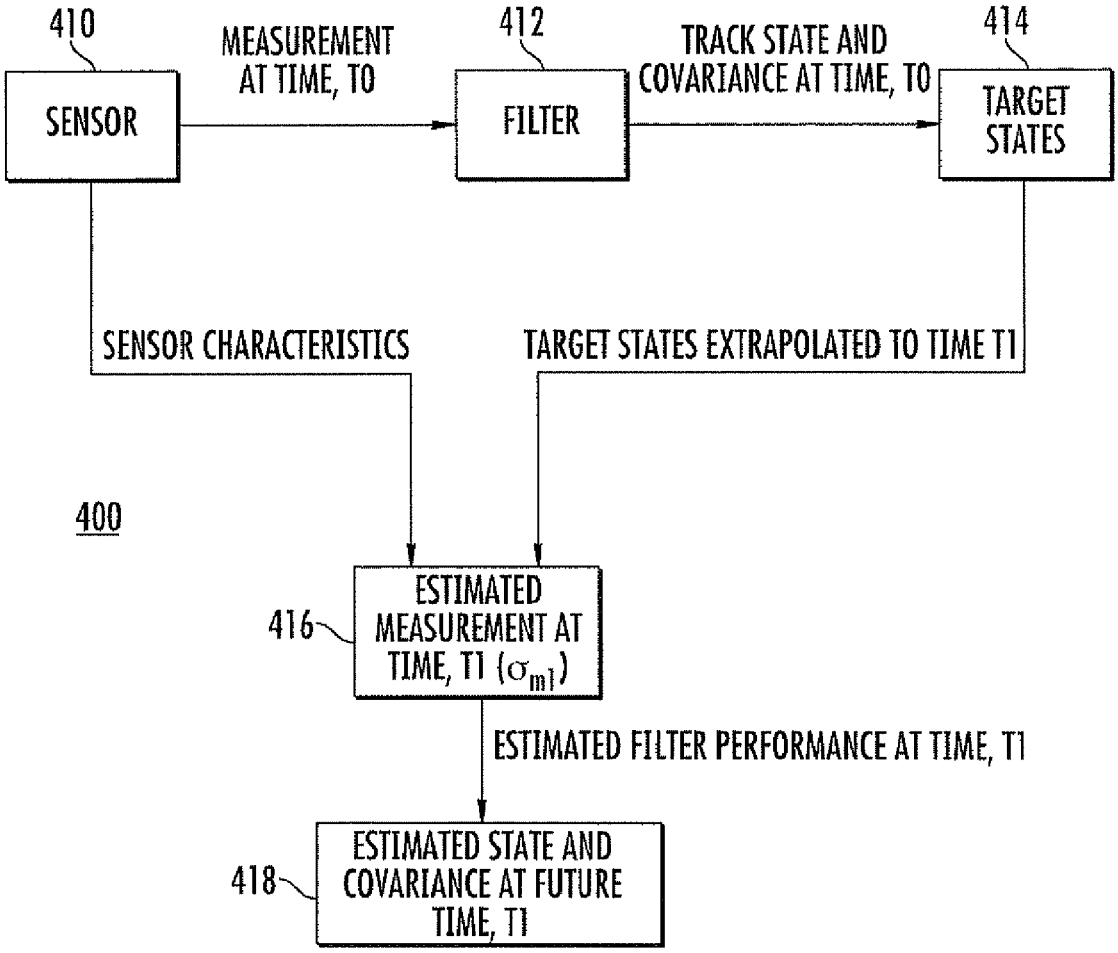
FIG. 4 is a simplified logic flow diagram showing processing for performing track quality determination in the flow of FIG. 2.

FIG. 4 is a simplified logic flow chart or diagram 400 illustrating track quality determination in block 214 of FIG. 2. In FIG. 4, a sensor measurement is illustrated as a block 410.

The sensor measurement at time T0 is represented as flowing to a block 412, which applies filtering to the measurement. This may be ordinary Kalman filtering, as known in the art, to provide state and covariance information at time T0. The stream of such information represents the target track. The state is applied to a block 414, which represents extrapolation of the target track forward in time, to thereby produce estimated target track information extrapolated to time T1. The estimated target track information from block 414 is applied to a block 416. Also applied to block 416 is information about the sensor(s) of block 410. This information about the sensor(s) of block 410 may include measurement accuracy and update rate. Block 416 uses the sensor characteristics together with the estimated target states at future time T1 (the estimated time of intercept) to estimate the measurements $\sigma_{m1}$ at the time T1. From block 416, the logic of FIG. 4 flows to a block 418, which represents application to the estimated measurements at future time T1 of the filtering associated with filter block 412, to thereby produce estimated state and covariance at future time T1. These estimated state and covariance results are made available from block 214 to block 216 of FIG. 2.

One method of estimating covariance at time T1 in block 418 of FIG. 4 is to assume the covariance at time T1 will be equal to the covariance at time T0. Another method of estimating the target covariance at time T1 considers the estimated target/sensor geometry at time T1, as well as the characteristics of the sensor such as measurement accuracy ($\sigma_m$) and update rate (1/dt). Update rate 1/dt at time T1 can be considered to be the same at that at time T0, but measurement accuracy $\sigma_m$ at T1 can be computed with knowledge of the accuracy at T0.

$$\sigma_{m1} = \sigma_{m0}\frac{R_1}{R_0}$$

where $\sigma_{m1}$ is the measurement accuracy at time T1;

$\sigma_{m0}$ is the measurement accuracy at time T0;

$R_1$ is the distance between sensor and target at time T1; and $R_0$ is the distance between sensor and target at time T0.

Having estimated dt and $\sigma_m$ at time T1, the designer can predict steady state target covariance at time T1, as is known in the art, when measurement accuracy and update rate are given as an input to a filter. The processed track information including the sensor-related aspects as generated in block 214 of FIG. 2 may be viewed as including track quality information.

From block 214 of FIG. 2, the logic 200 flows to a block 215. Block 215 represents selection of one of the i types of available interceptors for further consideration. Once the ith interceptor type is selected, the logic 200 flows to a block 216. Block 216 represents determination of a plurality of target intercept times for the selected interceptor missile type. In the case of a fleet of ships, each of which carries various types of interceptor missiles, the determination of intercept time may include considerations of which ship is closest to the target missile. The determination of intercept time, taking into account the interceptor flight profile, is well known in the art, and is performed for the selected interceptor missile type. From block 216 the logic 200 flows to a block 218. Block 218 represents the computation of the interceptor states at time T1. Among the interceptor states are position and velocity. The interceptor states can be stored via tables, or can be estimated with closed form guidance equations. The relative geometry between the target using estimated target states obtained from block 214 and the estimated interceptor states at start search time T1 is computed in block 220. From block 220 of FIG. 2, the logic 200 flows to a block 222, which determines the probability of guidance.

Figure 6:
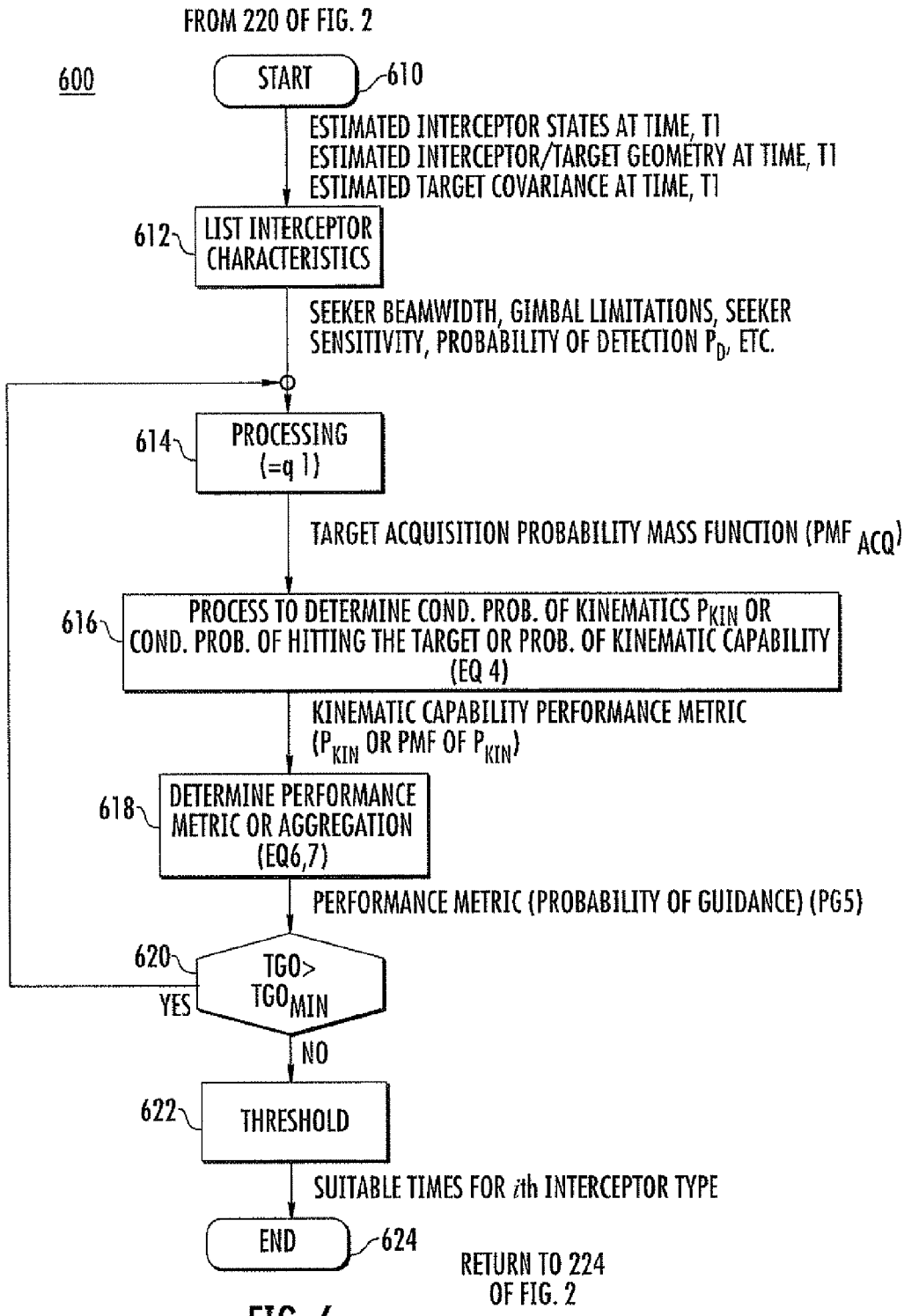
FIG. 6 is an illustration diagramming the logic flow or method for computing the probability of guidance in the flow of FIG. 2.

FIG. 6 is a simplified logic flow chart or diagram 600 illustrating calculation of probability of guidance performed in block 222 of FIG. 2. In FIG. 6, START block 610 represents starting of the logic 600. At the time of the starting of logic 600 of FIG. 6, certain information is available to the logic, including estimated interceptor states at time T1, estimated interceptor/target geometry at time T1, and estimated target covariance at time T1. From START block 610, the logic 600 flows to a block 612, which represents the listing or acquisition by the processing 24 of FIG. 1 of information relating to the characteristics of the selected interceptor missile. In the case in which the processing 24 of FIG. 1 is associated with a ship or a fleet of ships carrying various types of interceptor missiles, the interceptor missile information might include the seeker beamwidth BW, gimbal limitations including maximum seek look angle $\Psi$ of the interceptor missile seeker, the number of beams making up the search pattern of the seeker, the time required for the beam, if only one, to scan over the entire search angle, transmitter power (illuminator or seeker), acceleration (or other kinematic capability), interceptor autopilot lag, missile states at time of seeker activation, probability of detection, and receiver or net radar sensitivity. Net radar sensitivity is a simple way to refer to the overall radar capability, including seeker beamwidth, gimbal limitations, number of beams or scan time, and transmitter power. Some or all of this information may be pre-stored in the processor or in memory associated with each ship or other interceptor missile carrier, so long as the memory is accessible to the processor on an as-needed basis. From block 612, logic flow 600 proceeds to processor block 614, which evaluates the ability of the interceptor to acquire the target given the seeker characteristics of the given interceptor, the interceptor-target geometry and the target track covariance, expressed as the probability mass function $PMF_{ACQ}$.

Figure 5A:
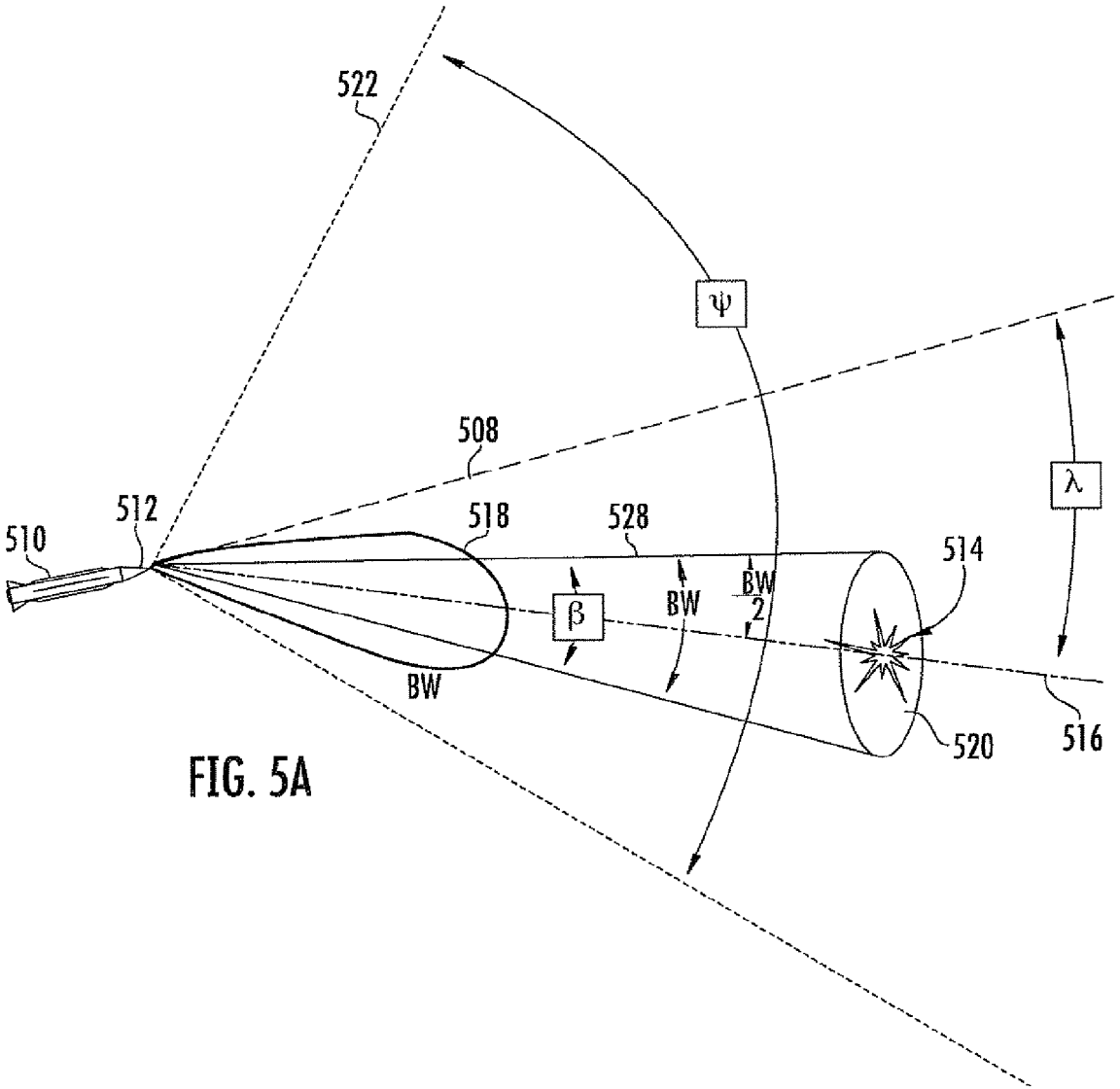
FIG. 5A is a simplified diagram illustrating the geometry associated with sensing a target during interceptor operation.

FIG. 5A is a simplified representation of an interceptor missile 510 including a seeker illustrated as a cone 512 at the lead end of the missile. The seeker 512 is centered on the longitudinal axis 508 of the missile. An estimated target state or location is illustrated as 514, on a line 516 at an angle $\lambda$ from longitudinal axis 508. The target uncertainty is illustrated by a circle 520 lying in a plane orthogonal to line 516. The missile 510 seeker 512 operates semi-actively or actively in order to acquire and track the target missile 514. For this purpose, the seeker 512 may be assumed to produce an antenna beam responsive to at least reflected electromagnetic energy from the target. The antenna beam is defined, at least in part, by the "beamwidth," (BW) well known in the art. As used in the art, the beamwidth often corresponds to twice the angle between the beam centerline (such as line 516) and a line such as 528) extending from the beam origin to a point at which the seeker antenna peak gain envelope drops by some power level. A 3 dB drop in power (−3 dB or a reduction by half) is often used. The beam is illustrated in FIG. 5A by a bulbous shape 518 having a half-beamwidth-angle BW/2 and a beamwidth of BW. The beamwidth of the seeker antenna will generally be as narrow as possible so as to improve the antenna gain along the most sensitive axis of the antenna. In general, the beamwidth of an antenna cannot be made arbitrarily small due to physical limitations on the size of the antenna that the interceptor missile can carry. In order to be assured that the target can be acquired, the sensor 512 must cover not only the target location 514, but also the extent of the uncertainty represented by circle 520. The uncertainty circle 520 as illustrated in FIG. 5A subtends an angle of β at the seeker. The physical limitation of the seeker to search in angle is due to gimbal hardware. The maximum included angle that can be searched is represented by line 522, and is indicated by angle ψ. A target that is located at an angle greater than ψ/2 relative to the centerline of the missile cannot be detected by the missile seeker, regardless of size of uncertainty area 520.

Figure 5B:
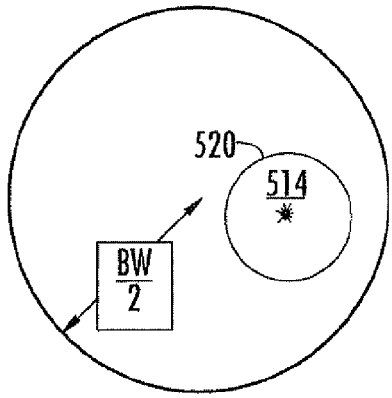
FIG. 5B is a diagram looking along a line of FIG. 5A toward the target, showing the uncertainty and a representative beamwidth.
Figure 5C:
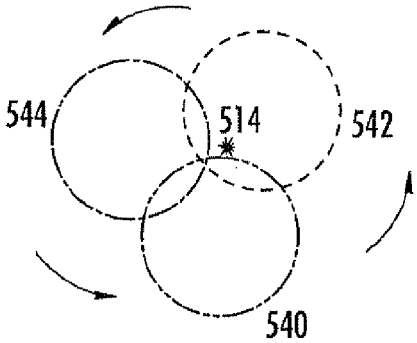
FIG. 5C is a diagram showing multiple locations to which the seeker beam must be steered in order to perform a search of the full uncertainty area in which search of each location is referred to as one beam scan.

FIG. 5B illustrates a notional view of the target as seen from the seeker. In FIG. 5B, the seeker half-beamwidth BW/2 is projected onto a plane normal to the seeker line-of-sight. The target location uncertainty is represented by a circle 520, and the target location is represented by 514. In order to have the best chance of detecting the target, the interceptor missile seeker antenna beam may be directed at a multiplicity of points in the uncertainty region. FIG. 5C is a simplified representation of an antenna beam scan. In FIG. 5C, an antenna beamwidth in sequential positions is illustrated by circles designated 540, 542, and 544. The sequential positions represent an overall scan over a region about the target location 514.

As mentioned, block 612 of FIG. 6 represents the acquisition or listing of the characteristics of the various available interceptor missiles. The types of information may include interceptor acceleration capability and autopilot lag, the seeker beamwidth BW, maximum seeker look angle $\alpha_{MAX}$, radar receiver sensitivity and/or transmit power, probability of detection for a single scan, time/range to begin search, and time required to scan.

The logic 600 of FIG. 6 flows from block 612 to a block 614, which represents processing for determination of the probability mass function (PMF) of acquisition of the target ($PMF_{ACQ}$) by the seeker of each different types of interceptor missile. A specific search of a given uncertainty area is referred to as a "look." More particularly, the $PMF_{ACQ}$ is the probability that the target will be acquired during a look, provided that the target has not been previously detected. $PMF_{ACQ}$ is assumed to have a binomial distribution and can be computed by the equation $$PMF_{ACQ}=(P_D/NBR)(1-P_D/NBR)^{NB/NBR}(1-P_D)^{NSL-1} \quad (1)$$

where:

$P_D$ is the seeker's probability of detection (a probability associated with the radar receiver for a given target radar cross section and range, as is known in the art);

NBR is the number of seeker scans required to cover the entire target uncertainty area;

NB is the beam number completed in searching the entire area, the value of NB cannot exceed NBR; and NSL is the number of initiated searches of the uncertainty area.

Figure 5D:
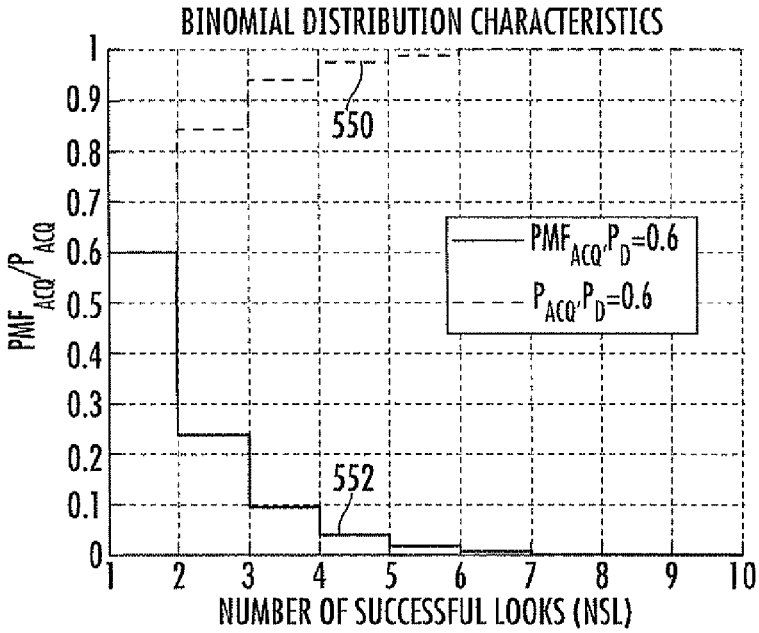
FIG. 5D is a plot of a) the cumulative probability distribution of detecting the target at least once as a function of number of looks at the target uncertainty area and (b) the probability of detecting the target on the last look at the target uncertainty area for a probability of detection ($P_D$) of 0.6 associated with the interceptor seeker.

There can be as few as one scan per look, or multiple scans per look, as suggested by FIG. 5C. The probability of acquisition, $P_{ACQ}$, increases with the number of successful looks (NSL) and $PMF_{ACQ}$ decreases as the number of successful looks decrease, as suggested by plots 550 and 552 of FIG. 5D.

It should be noted that the seeker probability of detection (PD) is a strong function of signal-to-noise ratio (SNR) which in turn is a strong function of target radar cross-section (RCS). The value of PD to use in computing equation (1) may be chosen conservatively so that the problem of computing PD for various target RCS and missile-target range values can be avoided. A conservative value of PD may be obtained by assuming a default target RCS.

Thus, processing block 614 of FIG. 6 represents determination of the probability of acquisition $PMF_{ACQ}$ associated with each different type of interceptor missile. From block 614, the logic of FIG. 6 flows to a processing block 616, which represents determination of the conditional probability of kinematics $P_{KIN}$ (or PMF of $P_{KIN}$), also known as conditional probability of hitting the target or the probability of kinematic capability, for the selected interceptor, given that the interceptor has acquired the target. The conditional probability of hitting the target is the conditional probability of the interceptor-missile-to-target miss distance being less than some effective lethal warhead radius (or vehicle radius in the case of a kinetic-kill vehicle).

Figure 7:
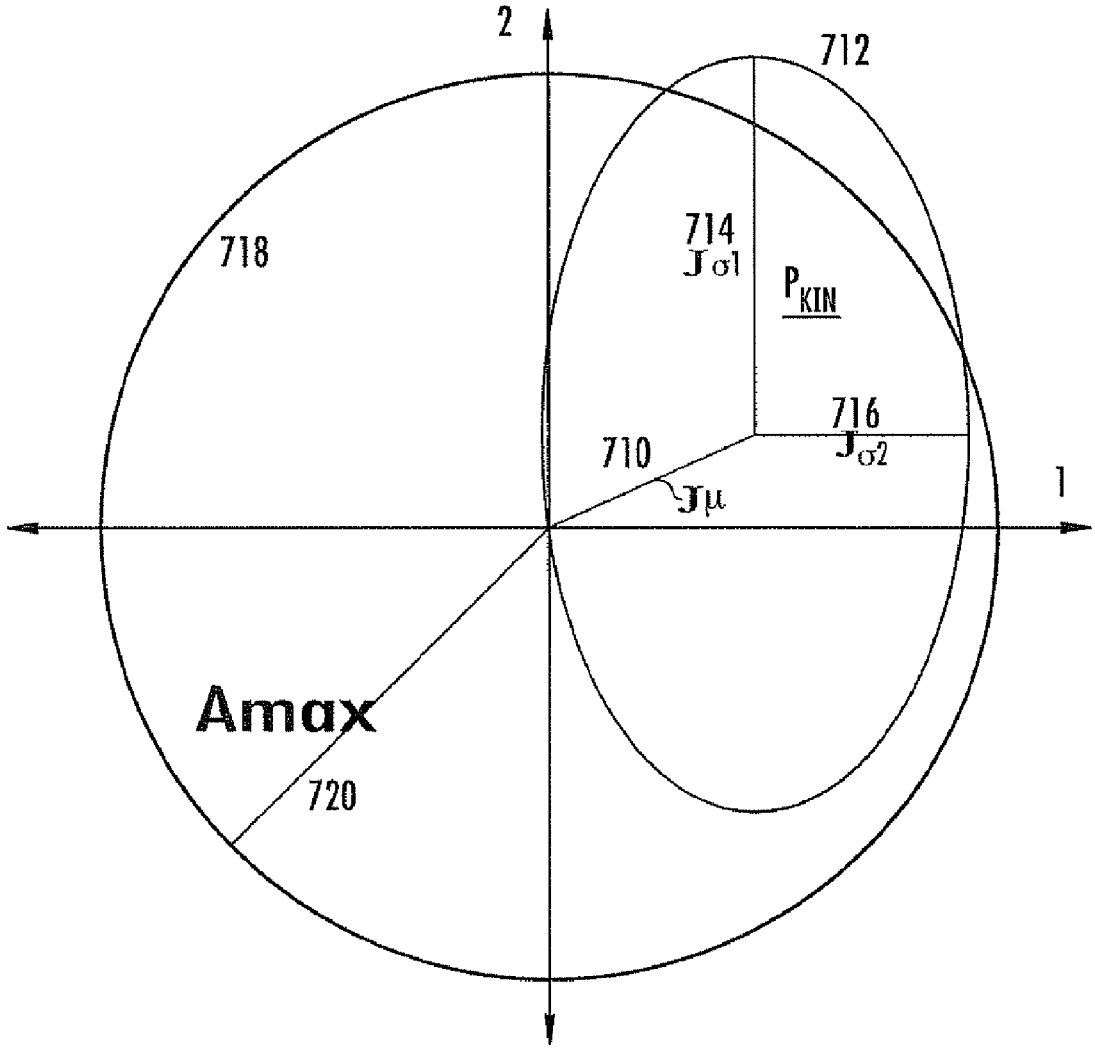
FIG. 7 is a drawing illustrating the probability of containment of a certain Gaussian ellipse, within a circle, given that the center of the ellipse is displaced from the center of the circle by some value.

FIG. 7 is an illustration of the conditional probability of kinematics ($P_{KIN}$) requirement associated with block 616. $P_{KIN}$ is a containment probability, as is known in the art. It is the probability that (a) the commanded interceptor acceleration Jσ1 orthogonal to the interceptor body along axis 1 represented by line 714 and (b) commanded interceptor acceleration Jσ2 orthogonal to the interceptor body along axis 2 represented by line 716 are both less than the maximum interceptor acceleration capability Amax represented by circle with radius 720, assuming the interceptor has already acquired the target. The commanded interceptor acceleration Jσ1 and Jσ2 form the semi-major axis 714 and semi-minor axis 716, respectively, of an ellipse 712 and are each proportional to the component of target position random error in the target uncertainty estimation at time T1 as described in conjunction with the discussion of block 418 of flow 400 of FIG. 4. The maximum interceptor acceleration is the radius of the circle Amax denoted by circle 720 of FIG. 7 to reflect the assumption that the maximum interceptor acceleration along axis 1 is equal to the maximum interceptor acceleration along axis 2. Ellipse 712 and circle 718 lie in the Cartesian plane normal to the missile-target line-of-sight. The area of intersection of ellipse 712 and circle 720 is the conditional probability of kinematics ($P_{KIN}$). Target position bias errors will shift ellipse 712 from the origin by an amount equal to the required acceleration due to target uncertainty bias, which acceleration is represented by line 710. Amax is based on structural or software limitations, which often depend upon missile speed and altitude, minus any acceleration required to counter heading errors introduced by the interceptor during the terminal homing phase of flight such as by seeker radome errors. Ideally, the interceptor commanded acceleration due to target position errors are less than the maximum interceptor acceleration capability and the probability that the commanded acceleration is contained within the maximum interceptor acceleration is high.

Block 616 of FIG. 6 computes the conditional probability of kinematics (denoted $P_{KIN}$ or PMF of $P_{KIN}$) for each selected-interceptor/target pair, assuming acquisition has been successful. For calculation of each conditional probability of kinematics, (a) the interceptor's maximum available acceleration Amax, (b) the estimated heading error (he) at that time, and (c) the range from the interceptor missile to target missile (rtm) are required. $P_{KIN}$ is defined as the probability of containing the distribution of required missile acceleration due to target covariance within the maximum available interceptor acceleration Amax, where the target covariance is described by the magnitude of bias uncertainty Jμ (FIG. 7) and random uncertainty in the two axes perpendicular to the interceptor-to-target line-of-sight. These two axes are designated $J_{o1}$ and $J_{o2}$ in FIG. 7 The interceptor acceleration required to overcome the heading error due to target uncertainty is defined by Jμ and $J_{oi}$, which are related to errors μ and $\sigma_p$ as shown below.

$$J_\mu = \frac{V_C^2}{R_{TM}^2}\mu \tag{2}$$

$$J_{\sigma i} = \frac{V_C^2}{R_{TM}^2}\sigma_{pi} \tag{3}$$

where:

$V_C$ is the rate at which the interceptor and target are approaching each other along the interceptor-to-target line-of-sight;

$R_{TM}$ is the distance between the interceptor and the target at the time of the beam scan;

$\mu$ is the bias component of the target uncertainty;

$\sigma_{pi}$ is the random component of the target uncertainty area in the $i^{th}$ plane perpendicular to the interceptor-to-target line-of-sight.

In a particular mode of the method of the invention the calculation of $P_{KIN}$ is represented by the cumulative distribution of the Rayleigh distribution, provided $\mu=0$ and that $\sigma_{p1}=\sigma_{p2}$ (target position uncertainty is symmetrical in the plane normal to the interceptor-to-target line-of-sight). For this condition, $P_{KIN}$ is given by $$P_{KIN} = 1 - \exp\left(\frac{-A_{max}^2}{2J^2}\right) \tag{4}$$

where:

Amax is the maximum available interceptor acceleration (based on structural or software limitations, which often depend upon missile speed and altitude, as well as the acceleration required to counter heading errors introduced by the interceptor during the terminal homing phase of flight);

J is the amount of energy required to remove the heading error to the target; J is defined as:

$$J = \frac{V^2}{Rtm}\sin(he) = \frac{V^2}{Rtm^2}\sigma_p \tag{5}$$

where:

V is the estimated closing velocity at the time of the beam scan which resulted in a target, the computation of which is known in the art;

Rtm is the estimated missile-to-target distance;

Sin(he) is the sine of the heading error, as known in the art; and $\sigma_p$ is the standard deviation of the target covariance normal to the interceptor-to-target line-of-sight ($\sigma_p=\sigma_{p1}=\sigma_{p2}$).

From block 616, the logic 600 of FIG. 6 flows to a processor block 618, which represents determination of a performance metric, which is the instantaneous probability of guidance $P_{GI}$. In effect, the probability of guidance is the probability of "hitting" the target. This determination results from the multiplicative product of (a) the conditional probability of kinematics ($P_{KIN}$) and (or with) (b) the probability mass function of acquisition ($PMF_{ACQ}$), which product is also termed "(a) an aggregation of the conditional probability of kinematics and (b) the probability mass function of acquisition". More particularly, the value of instantaneous probability of guidance $P_{GI}$ is summed with the value $P_{GI}$ of the previous seeker scan.

$$P_{GI}(n) = (PMF_{ACQ})(P_{KIN}) \tag{6}$$

$$P_G = \sum_{n=1}^{F} P_{GI}(n) \tag{7}$$

where:

$P_{GI}(n)$ is the instantaneous probability of guidance for a particular beam scan number, n; and $P_G$ is the probability of guidance.

From block 618 of FIG. 6, the logic 600 flows to a block 620. Block 620 is a decision block which compares time-to-go (to intercept) TGO with a minimum time-to-go $TGO_{MIN}$. Block 620 performs the comparison of the time-to-go to a critical value, $TGO_{MIN}$. $TGO_{MIN}$ represents a limitation in the missile airframe by which detection after $TGO_{MIN}$ would not provide the interceptor with sufficient time to nullify the heading error. If time-to-go is less than $TGO_{MIN}$, decision block 620 returns the logic 600 process is looped back to block 614. If time-to-go TGO is greater than or equal to minimum time-to-go $TGO_{MIN}$, the process proceeds to a threshold block 622.

From block 620 of FIG. 6, the logic 600 flows to a block 622, which represents application of the probability of guidance performance metric $P_G$ to a threshold for the selected interceptor. The threshold is a lower limit of acceptable missile performance ($P_G$). Any intercept with an expected $P_G$ above the threshold is considered as a potential engagement. The processing 600 of FIG. 6 is performed many times, to result in a plurality of potential intercept points. From the plurality of intercept points evaluated which meet the threshold criteria, an engagement can be scheduled which is expected to result in satisfactory interceptor performance.

From block 622, the logic of FIG. 6 flows to an END block 624. This block represents the completion of the logic 600 Of FIG. 6 (corresponding to the logic of block 222 of FIG. 2). The logic flows from END block 624 of FIG. 6 to block 224 of FIG. 2. As mentioned, block 222 determines estimated interceptor success or probability of guidance for each possible interceptor, as detailed in conjunction with logic 600 of FIG. 6.

From block 222 of FIG. 2, the logic 200 flows to a block 224 for selection of suitable intercept times for the selected interceptor type, corresponding launch times for each interceptor type, and intercept location for the selected interceptor type.

From block 224 of FIG. 2, the logic 200 flows to block 224A to determine if all available interceptor types have been evaluated. If all of the interceptor types have not been evaluated the logic leaves 224A to block 214A to select the next interceptor type to be evaluated. If all of the interceptor types have been evaluated the logic leaves the decision block 224A to block 225 to select an interceptor for launch.

From block 224A of FIG. 2, the logic 200 flows to block 225 to select an interceptor type to launch. The step of selecting an interceptor type includes listing the probability of guidance ($P_G$) for all the intercept points that satisfy the threshold criteria of block 622 in logic 600 in FIG. 6 for each interceptor type and selecting the interceptor type having either (a) the maximum $P_G$ or (b) the earliest intercept time. In the event that the maximum value between two interceptors are substantially similar either of the corresponding interceptors can be selected.

With the interceptor type and launch times selected, the logic 200 of FIG. 2 flows from block 225 to a block 226, which represents the launching of the selected interceptor missile, and guiding the missile toward the target according to the assumptions made in the prior processing. From block 226, the logic of FIG. 2 flows to an END block 228. This represents completion of this aspect of the engagement. The method may be repeated as many times as may be necessary, so long as targets and interceptor missiles are available.

In general, a method for engaging a target according to an aspect of the invention uses sensors to generate target track(s). The tracks are projected forward in time and associated with a track quality measure. The maximum seeker look angle and beamwidth, acceleration, and net radar sensitivity characteristics are listed for each type of interceptor. A plurality of target intercept times are generated for each interceptor type. The probability that the interceptor can acquire the target is determined from the projected target tracks, the quality measure, and the characteristics. The probability of hitting the target is determined from the probability of acquisition and acceleration of the interceptor type. The probabilities of acquisition and of hitting the target are aggregated, and the type of interceptor to use is the type having (a) an extreme value of the aggregation or (b) the earliest intercept time from among the interceptors having an aggregation value above a threshold value.

Thus, a method for engaging a target (14) according to an aspect of the invention comprises the steps of providing a plurality of sensors (16*a*, 16*b*, 18) for producing track data (15, 26) representing target tracks. These target tracks (15, 26) are subject to uncertainty in the form of state and covariance, as known in the art. The target tracks are projected forward in time (214, 400) to thereby generate projected target tracks. The projected target tracks are evaluated (400), and an estimated quality measure ($\sigma_m$) is associated (418) with each projected target track. A listing is generated (612), either on-the-fly or from stored information, listing at least the characteristics of (a) maximum seeker look angle ($\psi$) with its uncertainty, (b) acceleration or other kinetic capability (Amax), (c) seeker beamwidth (BW), and (d) the net radar sensitivity (including transmitter power), for all available interceptor missiles (32). The characteristics may preferably include the interceptor autopilot lag. A plurality of target intercept times are determined (216) for each of the types of interceptor. The probability that the interceptor can acquire the target (possibly expressed as the probability mass function $PMF_{ACQ}$) is determined (614) for each of the available interceptor missiles (32) and for each of the plurality of intercept times, using the target tracks, the quality measures, and the characteristics. The probability of the interceptor missile hitting the target ($P_{KIN}$ or PMF of $P_{KIN}$) is determined (616) for each of the interceptor missile types, using the track quality ($\sigma_m$), the probability mass function of the acquisition of the target by the missile ($PMF_{ACQ}$) (614), and the acceleration or kinematic characteristics of the interceptor missile (Amax). The probabilities of acquisition ($PMF_{ACQ}$) and the probabilities of hitting the target ($P_{KIN}$) are aggregated (618) for each type of interceptor missile, and the type of interceptor missile to use is determined by selecting (225) either (a) that type of interceptor missile having a maximum value of the aggregation (618) which exceeds the threshold value (622) or (b) that type of interceptor that has the earliest intercept time (224) that exceeds the threshold value (622). A further step (226) may include at least one of launching and controlling the selected one of the interceptor missiles (34).

In a particular mode of the method, the step of aggregating (618) includes the steps of computing the probability mass function (614) of the probability of target acquisition and the conditional probability of kinematic capability (616) given target acquisition after each seeker scan, and summing the product of the probability mass density and the probability of kinematic capability over a finite number of seeker scans (618) to compute the probability of guidance ($P_G$).

In one mode of the method, the step (418) of evaluating the target tracks and associating an estimated quality measure with each projected target tracks is based upon estimated sensor errors as a function of range.

A method according to an aspect of the invention is for engaging a target. The method comprises the steps of providing a plurality of sensors (16*a*, 16*b*) for producing track data representing target tracks (15, 26). The track data is projected forward in time (214) to thereby generate projected target tracks (26) including target state and covariance. The projected target tracks (26) are evaluated, and an estimated quality measure is associated (214) with each projected target track. For all available interceptor missiles, a listing is generated (612) of at least the characteristics of (a) maximum seeker look angle, (b) maximum acceleration or other kinematic capability, (c) net radar sensitivity, (d) seeker beamwidth and (e) and possibly interceptor autopilot lag. A plurality of target intercept times is determined (216) for each of the available types of interceptors. For each of the plurality of target intercept times, and using the projected target tracks, the quality measures, and the characteristics, a determination is made (614), for each of the available interceptors, of the target acquisition probability mass function $PMF_{ACQ}$. For each of the interceptor types, from the maximum available interceptor acceleration or other kinetic capability and from the amount of energy required to remove the heading error to the target, a determination is made (616) of one of the conditional probability of kinematics ($P_{KIN}$) and the probability mass function of the probability of kinematics (PMF of $P_{KIN}$). The instantaneous probability of guidance ($P_{GI}$) or probability of hitting the target is generated (618) as an aggregation which is the multiplicative product of (a) the target acquisition probability mass function ($PMF_{ACQ}$) and (b) the one of the conditional probability of kinematics ($P_{KIN}$) and the probability mass function of the probability of kinematics (PMF of $P_{KIN}$). The type of interceptor to be launched is selected (226) as that type having an extreme value of the resulting aggregation. The extreme value may be a maximum. In a particular mode of this method, the selected one of the interceptors is launched. Another mode of the method further comprises, after the step of determining the instantaneous probability of guidance ($P_{GI}$) or probability of hitting the target, the step (622) of selecting for further processing only those values of probability of guidance ($P_G$) or probability of hitting the target which exceed a given threshold, representing a lower limit of acceptable missile performance, to thereby define a set of acceptable interceptors. Yet another mode further comprises the step of determining, if not already determined, target intercept time for each interceptor of the set of acceptable interceptors, and selecting (224) from among the interceptors of the set that one having the earliest intercept time.

In yet another mode of a method according to an aspect of the invention for engaging a target or missile (14), the mode comprises the steps of providing a plurality of sensors (16*a*, 16*b*, 18) for producing track data representing target tracks (15, 26). These target tracks (15, 26) include target state information together with uncertainty in the form of state and covariance, as known in the art. A composite target track, constructed from a single sensor's data or multiple sensor measurement streams, is produced for each target missile, as is known in the art (412). The composite target track is projected forward in time (416), and the projected target track is associated (416) with an estimated quality measure ($\sigma_{m1}$).

The estimated quality measure ($\sigma_{m1}$) may be based upon estimated sensor errors as a function of range. For each available interceptor missile type, a listing is prepared (612) of at least the characteristics of (a) seeker angle ($\lambda$) with its uncertainty, (b) the seeker gimbal limitations ($\psi$) and (c) the net radar sensitivity, which can be described as probability of detection ($P_D$) and range from interceptor missile to target. A plurality of potential target intercept times are determined (614 through 620) for each type of interceptor missile (216). For each of the plurality of intercept times, and using the target tracks, the quality measures, and the characteristics, the probability that the interceptor missile can acquire the target is determined (620) for each of the available interceptor missile types (as a function of the number of seeker scans). For each of the interceptor missile types, the probability of hitting the target ($P_G$) is determined (622) from (a) the track quality ($J_\mu$, $J_{\sigma 1}$, and $J_{\sigma 2}$), (b) the probability of acquisition ($PMF_{ACQ}$), and (c) the available acceleration (or other kinematic characteristics) ($A_{max}$) of the interceptor missile type. The probability of hitting the target is the probability that the interceptor missile-target miss distance is less than some effective lethal warhead radius. A determination is made (224) of which type of interceptor missile to use by aggregating (618) the probabilities of acquisition and conditional probabilities of hitting the target, and selecting (622) as the type of interceptor missile that type having a value of the aggregation which exceeds a given threshold. In a particular mode of the method, the step of aggregating (618) includes the steps of multiplying the probability mass function of acquisition ($PMF_{ACQ}$) with (or by) the conditional probability of hitting the target ($P_{KIN}$) to produce a product at a specific time in the seeker search process, and the step (618) of summing the product over the search time until the time-to-go threshold has been reached. In a preferred mode of the method, a further step (226) includes at least one of launching (226) and controlling (226) the selected one of the interceptor missiles (32).

What is claimed is:

1. A method for engaging a target, said method comprising the steps of:

providing a plurality of sensors for producing track data representing target tracks;

projecting said track data forward in time to generate projected target tracks;

evaluating said projected target tracks and associating an estimated quality measure with each projected target track;

for each of a plurality of interceptor missiles, listing at least characteristics of (a) maximum seeker look angle with associated uncertainty, (b) acceleration or other kinematic capability, (c) seeker beamwidth, and (d) net radar sensitivity;

determining a plurality of target intercept times for each of a plurality of types of interceptor missiles;

for each of said plurality of target intercept times, using said projected target tracks, said estimated quality measures, and said characteristics to determine, for each of said plurality of interceptors missiles, a probability that the interceptor missile can acquire said target;

determining, for each of said plurality of interceptor missile types, a probability of hitting the target from the projected target track quality, the probability of acquisition of a particular type of interceptor missile, and the acceleration or other kinematic characteristics of said interceptor missile type;

determining which type of said plurality of interceptor missiles to use by aggregating said probabilities of acquisition and probabilities of hitting said target, and selecting an interceptor missile of said plurality of interceptor missiles having one of (a) an extreme value of the resulting aggregation and (b) the earliest intercept time from among those interceptors having a resulting aggregation above a minimum value.

2. A method according to claim 1, further comprising the step of at least one of launching and controlling the selected one of said plurality of interceptor missiles.

3. A method according to claim 1, wherein said step of listing the characteristics includes the step of listing autopilot lag of at least one of said plurality of interceptor missiles.

4. A method according to claim 1, wherein:

said step of aggregating includes the step of multiplying a probability mass function of target acquisition and a probability of hitting said target at a completion of each of at least one seeker scans, to generate a product of said probabilities; and summing a product of said probabilities over a finite number of seeker scans to compute a probability of guidance.

5. A method according to claim 1, wherein said step of evaluating said projected target tracks and associating an estimated quality measure with each projected target tracks is based upon estimated sensor errors as a function of range.

6. A method for engaging a target, said method comprising the steps of:

providing a plurality of sensors for producing track data representing target tracks;

projecting said track data forward in time to generate projected target tracks including target state and covariance;

evaluating said projected target tracks and associating an estimated quality measure with each projected target track;

for a plurality of interceptor missiles, listing at least characteristics of (a) maximum seeker look angle, (b) maximum acceleration or other kinematic capability, (c) net radar sensitivity (d) seeker beamwidth, and (e) interceptor autopilot lag;

determining a plurality of target intercept times for each of a plurality of types of interceptor;

for each of said plurality of target intercept times, and using said projected target tracks, said quality measures, and said characteristics, determining, for each of said plurality of interceptors, a target acquisition probability mass function;

determining, for each of said plurality of types of interceptor, one of a conditional probability of kinematics and a probability mass function of the probability of kinematics;

determining an instantaneous probability of guidance or probability of hitting the target as an aggregation which is the product of (a) the target acquisition probability mass function and (b) said one of the conditional probability of kinematics and the probability mass function of the probability of kinematics; and selecting as the type of interceptor to be launched that type of interceptor having an extreme value of the resulting aggregation.

7. A method according to claim 6, further comprising the step of launching at least one interceptor of the selected types of interceptor.

8. A method according to claim 6, further comprising, after said step of determining the instantaneous probability of guidance or probability of hitting the target, the step of selecting for further processing only those values of probability of guidance or probability of hitting the target which exceed a given threshold, wherein the given threshold represents a lower limit of acceptable missile performance, to define a set of acceptable interceptors.

9. A method according to claim 8, further comprising the step of determining, target intercept time for each interceptor of said set of acceptable interceptors, and selecting from among the set of acceptable interceptors that interceptor having an earliest intercept time.

10. A method according to claim 9, further comprising the step of launching that interceptor having the earliest intercept time.

11. A system for engaging a target, said system including:

a plurality of types of interceptor missiles, each of which types defines (a) a radar-based seeker defining characteristics of a maximum look angle with associated uncertainty, seeker beamwidth, and net radar sensitivity, and (b) a characteristic of maximum acceleration or other kinematic limit;

a plurality of sensors, each of said plurality of sensors for producing track data representing target tracks;

a filter arrangement coupled to said sensors for projecting said track data forward in time to generate projected target tracks;

a quality association processor coupled to said filter arrangement for evaluating said projected target tracks and for associating an estimated quality measure with each projected target track to produce at least target states and covariance;

a target intercept time processor coupled to said quality association processor, for determining, from at least said target states and covariance, a plurality of target intercept times for each of said types of interceptor missiles;

a target acquisition processor for, for each of said plurality of intercept times, and using at least said projected target tracks, said quality measures, and said characteristics, determining, for each of said types of interceptor missiles, a probability that the interceptor missile type can acquire said target;

a target hit probability processor for determining, for each of said interceptor missile types, a probability of hitting the target from the estimated quality measure, the probability that the interceptor missile can acquire the target, and the acceleration or other kinematic characteristics of said interceptor missile type; and an interceptor missile type identification processor for determining which type of interceptor missile to use for engaging said target by aggregating said probabilities of acquisition and probabilities of hitting said target, and for selecting as the type of interceptor missile that type having one of (a) an extreme value of the resulting aggregation and (b) the earliest intercept time from among those interceptors having the resulting aggregation above a minimum value.

12. A system according to claim 11, further comprising an interceptor launch and guidance controller for launching and guiding toward the target the selected one of said interceptor missiles.

13. A system according to claim 11, wherein:

said plurality of types of interceptor missiles further include a characteristic of autopilot lag, and wherein:

said target acquisition processor further uses said autopilot lag for determining, for each of said types of interceptors missiles, the probability that the interceptor missile type can acquire said target.

14. A system according to claim 11, wherein:

said interceptor type identification processor:

(a) multiplies a probability mass function of target acquisition and said probability of hitting said target at the completion of each of a plurality of seeker scans, to generate a product of said probabilities; and (b) sums the product of said probabilities over a finite number of said seeker scans to compute a probability of guidance.

15. A system for engaging a target, comprising:

a plurality of types of interceptor missiles;

a plurality of sensors for producing track data representing target tracks associated with a sensed target;

a filter arrangement coupled to said plurality of sensors for projecting said track data forward in time to generate projected target tracks;

a quality association processor coupled to said filter arrangement for evaluating said projected target tracks and for associating an estimated quality measure with each projected target track;

a target intercept time processor coupled to said quality association processor, for determining, using said estimated quality measure, a plurality of target intercept times for each of said types of interceptor missiles;

a target acquisition processor for determining, for each of said plurality of intercept times and for each of said types of interceptor missiles, a probability that the interceptor missile type can acquire said target;

a target hit probability processor for determining, for each of said types of interceptor missiles, a probability of hitting the target using the quality measure and the probability that the interceptor missile can acquire the target; and an interceptor missile type identification processor for determining which type of interceptor missile to use for engaging said target by aggregating said probability of acquisition and probability of hitting said target, and for selecting as the type of interceptor missile to use for engaging said target that type of interceptor missile having one of (a) an extreme value of the resulting aggregation and (b) an earliest intercept time.

16. The system of claim 15, wherein each of said plurality of types of interceptor missiles includes:

(a) a radar-based seeker defining characteristics of a maximum look angle with associated uncertainty, seeker beamwidth, and net radar sensitivity, and (b) a characteristic of maximum acceleration or other kinematic limit.

17. The system of claim 16, wherein said a target acquisition processor further uses said projected target tracks, said quality measures, and said characteristics to determine the probability that the interceptor missile type can acquire said target.

18. The system of claim 15, wherein said quality association processor produces, for each projected target track, at least a target state and an associated covariance.

19. The system of claim 18, wherein said target intercept time processor further uses at least said target state and associated covariance to determine said plurality of target intercept times.

20. The system of claim 15, wherein said target hit probability processor further uses acceleration or other kinematic characteristics of said interceptor missile type to determine said probability of hitting the target.

* * * * *